US010589978B2

(12) United States Patent
Sevcik et al.

(10) Patent No.: US 10,589,978 B2
(45) Date of Patent: Mar. 17, 2020

(54) BEVERAGE DISPENSERS WITH DUAL FLOW DISPENSING VALVES

(71) Applicant: Cornelius, Inc., Osseo, MN (US)

(72) Inventors: E. Scott Sevcik, Crystal Lake, IL (US); Rodney John Adams, London (GB); Guy Andrew Brinton, Cheltenham (GB)

(73) Assignee: Cornelius, Inc., Osseo, MN (US)

( * ) Notice: Subject to any disclaimer, the term of this patent is extended or adjusted under 35 U.S.C. 154(b) by 0 days.

(21) Appl. No.: 16/159,904

(22) Filed: Oct. 15, 2018

(65) Prior Publication Data

US 2019/0112176 A1 Apr. 18, 2019

Related U.S. Application Data

(60) Provisional application No. 62/572,227, filed on Oct. 13, 2017.

(51) Int. Cl.

| | |
|---|---|
| ***B67D 1/00*** | (2006.01) |
| ***B67D 1/14*** | (2006.01) |
| ***B67D 1/12*** | (2006.01) |

(52) U.S. Cl.

CPC ..... *B67D 1/005* (2013.01); *B67D 1/0021* (2013.01); *B67D 1/0083* (2013.01); *B67D 1/1286* (2013.01); *B67D 1/145* (2013.01); *B67D 1/1411* (2013.01); *B67D 1/1466* (2013.01); *B67D 2210/0006* (2013.01)

(58) Field of Classification Search

CPC ..... B67D 1/005; B67D 1/083; B67D 1/145; B67D 1/0021; B67D 1/0086; B67D 1/1466; B67D 1/1411; B67D 2210/0006

USPC ..... 222/245.5, 144.5, 145.7, 129.1, 145.5

See application file for complete search history.

(56) References Cited

U.S. PATENT DOCUMENTS

| | | | | |
|---|---|---|---|---|
| 2,208,611 A | | 7/1940 | Taylor | |
| 2,373,294 A | | 8/1941 | Cornelius | |
| 2,461,909 A | | 2/1949 | McClure | |
| 2,675,018 A | * | 4/1954 | Bender | B67D 1/0083 137/381 |

(Continued)

FOREIGN PATENT DOCUMENTS

| | | |
|---|---|---|
| EP | 1669322 | 6/2006 |
| WO | 2004044339 | 5/2004 |

*Primary Examiner* — Lien M Ngo

(74) *Attorney, Agent, or Firm* — Andrus Intellectual Property Law, LLP

(57) ABSTRACT

A beverage dispensing valve includes a manifold that receives and dispense a first liquid and a second liquid. The manifold has a first flow channel through which the first liquid is conveyed and a second flow channel through which the second liquid is conveyed. A first shutoff assembly has a valve seal on a leg disposed in the first flow channel and a second shutoff assembly has a valve seal on a leg disposed in the second flow channel. A handle assembly is coupled to the first shutoff assembly and the second shutoff assembly and movement of the handle assembly simultaneously moves the leg of the first shutoff assembly and the leg of the second shutoff assembly into an open position such that the first liquid flows through the first flow channel, the second liquid flows through the second flow channel, and the first liquid and second liquid mix downstream to form a mixed beverage.

20 Claims, 13 Drawing Sheets

(56) References Cited

U.S. PATENT DOCUMENTS

| | | | | | |
|---|---|---|---|---|---|
| 2,888,040 | A * | 5/1959 | Terwilliger | B67D 1/0083 | 137/607 |
| 3,291,441 | A | 12/1966 | Hansen | | |
| 3,448,769 | A * | 6/1969 | Cornelius | B67D 1/0082 | 137/607 |
| 3,455,332 | A * | 7/1969 | Cornelius | B01F 5/0077 | 137/381 |
| 4,509,690 | A * | 4/1985 | Austin | B01F 5/08 | 222/129.1 |
| 4,741,355 | A * | 5/1988 | Credle, Jr. | B67D 1/0044 | 137/269 |
| 4,742,942 | A | 5/1988 | Dokos et al. | | |
| 4,932,564 | A * | 6/1990 | Austin | B67D 1/0044 | 222/129.1 |
| 5,269,442 | A | 12/1993 | Vogel | | |
| 5,813,574 | A | 9/1998 | McNabb | | |
| 5,845,815 | A | 12/1998 | Vogel | | |
| 6,457,614 | B1 | 10/2002 | Amidzich | | |
| 8,955,723 | B2 | 2/2015 | Minica et al. | | |
| 9,873,605 | B2 * | 1/2018 | Santy | B67D 1/0044 | |
| 2003/0015551 | A1 * | 1/2003 | Henry | B67D 1/005 | 222/129.3 |
| 2005/0236435 | A1 | 10/2005 | Pfieffer et al. | | |
| 2009/0065529 | A1 | 3/2009 | Guadalupi | | |
| 2013/0256343 | A1 * | 10/2013 | Minica | B67D 1/0083 | 222/505 |

* cited by examiner

BEVERAGE DISPENSERS WITH DUAL FLOW DISPENSING VALVES

CROSS-REFERENCE TO RELATED APPLICATION

The present application is based on and claims priority to U.S. Provisional Patent Application No. 62/572,227 filed Oct. 13, 2017, the disclosure of which is incorporated herein by reference.

FIELD

The present disclosure relates to beverage dispensers, and specifically beverage dispensers with beverage dispensing valves that dispense two liquids.

BACKGROUND

The following U.S. patents are incorporated herein by reference in entirety.

U.S. Pat. No. 4,509,690 discloses a mixing nozzle for a post-mix beverage dispenser having a water supply chamber co-axially surrounding a syrup supply port, an elongate syrup diffuser having a spray head on its lower end, and an upper water distribution disc on the diffuser having a plurality of apertures having a cumulative opening area for passage of water, a convex frusto-conical water spreader directly below the upper disc, a lower water distribution disc spaced below the upper disc and the spreader, the lower disc has a plurality of apertures, and a clearance between itself and a nozzle spout.

U.S. Pat. No. 4,932,564 discloses a two flavor post-mix carbonated beverage dispensing head with a mounting block and valve body with a treble quick disconnect for water and two syrups, three flow controls in a first triangular structure, three valves and solenoids in a second triangular structure, sonic welded thermoplastic syrup tubes from the flow controls to the valves, and a unique mixing nozzle structure that brings either of the syrups and water convergently together.

U.S. Pat. No. 5,269,442 discloses a nozzle for a post-mix beverage dispensing valve. The nozzle includes a first diffuser plate followed by a central flow piece having a frusto-conical outer water flow surface and an interior syrup flow channel. Second and third diffuser plates follow the frusto-conical portion. The second and third diffuser plates have perimeter edges that contact the inner surface of a nozzle housing so that the carbonated water must flow through holes in the diffusers. In this manner, the gradual reduction of pressure of the carbonated water to atmospheric can be controlled in part by increasing the surface area of the holes in each successive diffuser.

U.S. Pat. No. 5,845,815 discloses a piston based flow control for use in a high flow beverage dispensing valve. The piston thereof includes a top perimeter edge structure that allows for continuity of liquid flow during high flow applications and particularly during the initiation of a high flow dispensing to eliminate chattering of the piston.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a beverage dispensing valve includes a manifold configured to receive and dispense a first liquid and a second liquid. The manifold has a first flow channel through which the first liquid is conveyed and a second flow channel through which the second liquid is conveyed. The second flow channel is parallel to and separated from the first flow channel. A first shutoff assembly has a valve seal on a leg disposed in the first flow channel. The leg is movable into and between a closed position in which the valve seal blocks the flow of the first liquid through the first flow channel and an open position in which the valve seal is open such that the first liquid flows through the first flow channel. A second shutoff assembly has a valve seal on a leg disposed in the second flow channel. The leg is movable into and between a closed position in which the valve seal blocks the flow of the second liquid through the second flow channel and an open position in which the valve seal is open such that the second liquid flows through the second flow channel. A handle assembly is coupled to the first shutoff assembly and the second shutoff assembly such that movement of the handle assembly simultaneously moves the leg of the first shutoff assembly and the leg of the second shutoff assembly into the open position such that the first liquid flows through the first flow channel, the second liquid flows through the second flow channel, and the first liquid and the second liquid mix downstream to form a mixed beverage.

In certain examples, a beverage dispensing valve includes a manifold configured to receive and dispense a first liquid and a second liquid. The manifold has a first flow channel through which the first liquid is conveyed and a second flow channel through which the second liquid is conveyed. A first shutoff assembly has a valve seal on a leg disposed in the first flow channel, and the leg is movable into and between a closed position in which the valve seal blocks the flow of the first liquid through the first flow channel and an open position in which the valve seal is open such that the first liquid flows through the first flow channel. A second shutoff assembly has a valve seal on a leg disposed in the second flow channel, and the leg is movable into and between a closed position in which the valve seal blocks the flow of the second liquid through the second flow channel and an open position in which the valve seal is open such that the second liquid flows through the second flow channel. A handle assembly is coupled to the first shutoff assembly and the second shutoff assembly and a dispensing arm is coupled to the first shutoff assembly and the second shutoff assembly such that movement of one of the handle assembly and the dispensing arm simultaneously moves the leg of the first shutoff assembly and the leg of the second shutoff assembly into the open position such that the first liquid and the second liquid flow through the first and second flow channels and the first and second liquid mix downstream of the first and second flow channels to form a mixed beverage.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Conventional beverage dispensers are commonly used to dispense post-mixed beverages. These beverage dispensers typically include at least one beverage dispensing valve from which liquids, such as high fructose corn syrup and carbonated water, are dispensed and form a mixed beverage. The present inventors have recognized that some consumers perceive mixed beverages dispensed from beverage dispensing valves with pull handles to have high quality and value. For example, beverage dispensing valves for beer can include branded beer pull handles. Accordingly, the present inventors have endeavored to create beverage dispensing valves with operable handle assemblies that dispense mixed craft beverages formed from two liquids. Furthermore, the present inventors have endeavored to create beverage dispensing valves with operable handle assemblies that can be connected to backblock mounting assemblies of conventional beverage dispensers. In addition, the present inventors have endeavored to create beverage dispensing valves that maintain separation between the liquids forming the mixed beverage until the liquids are dispensed thereby preventing deterioration and contamination of the liquids.

Figure 1:
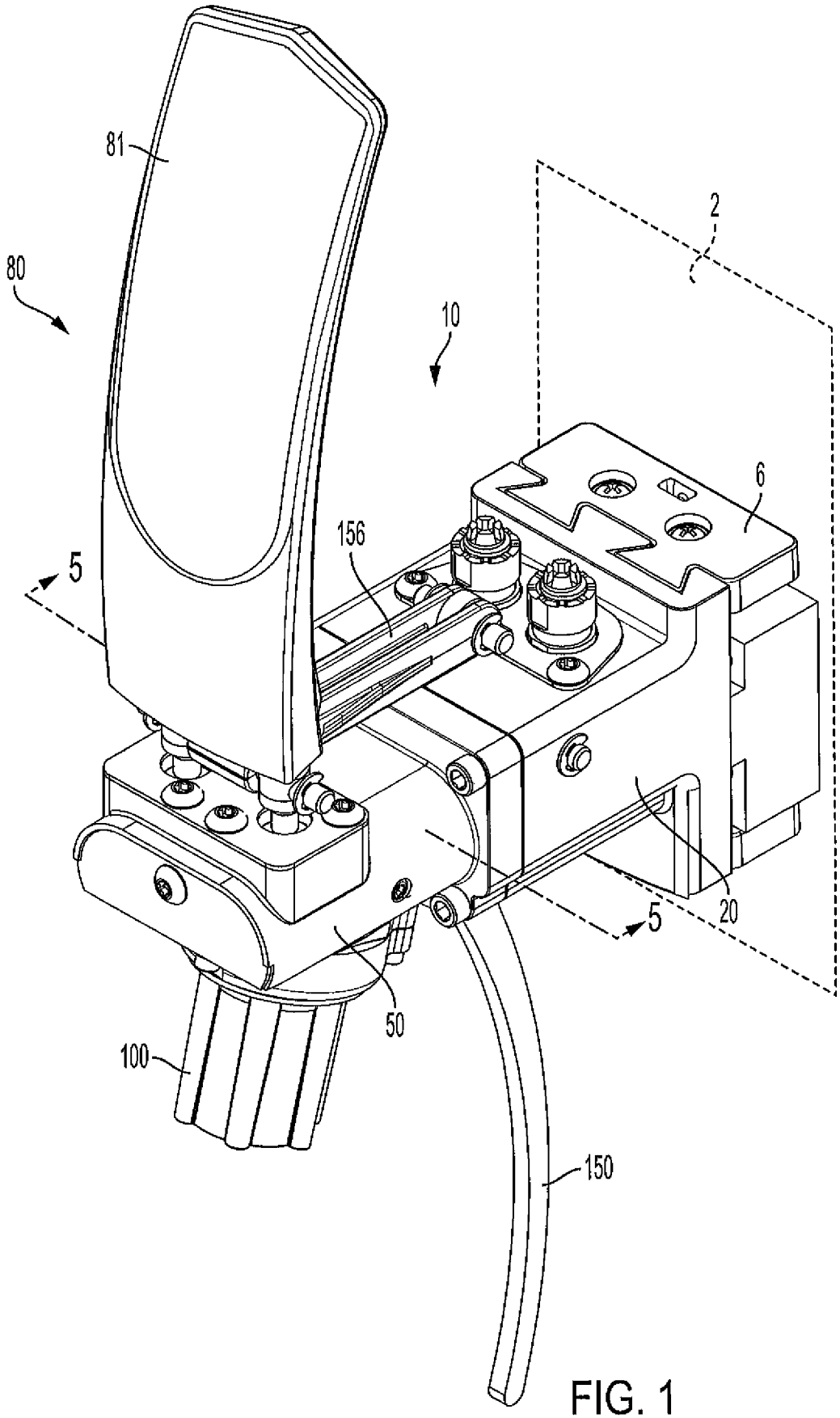
FIG. 1 is a top perspective view of an example beverage dispensing valve according to the present disclosure.
Figure 2:
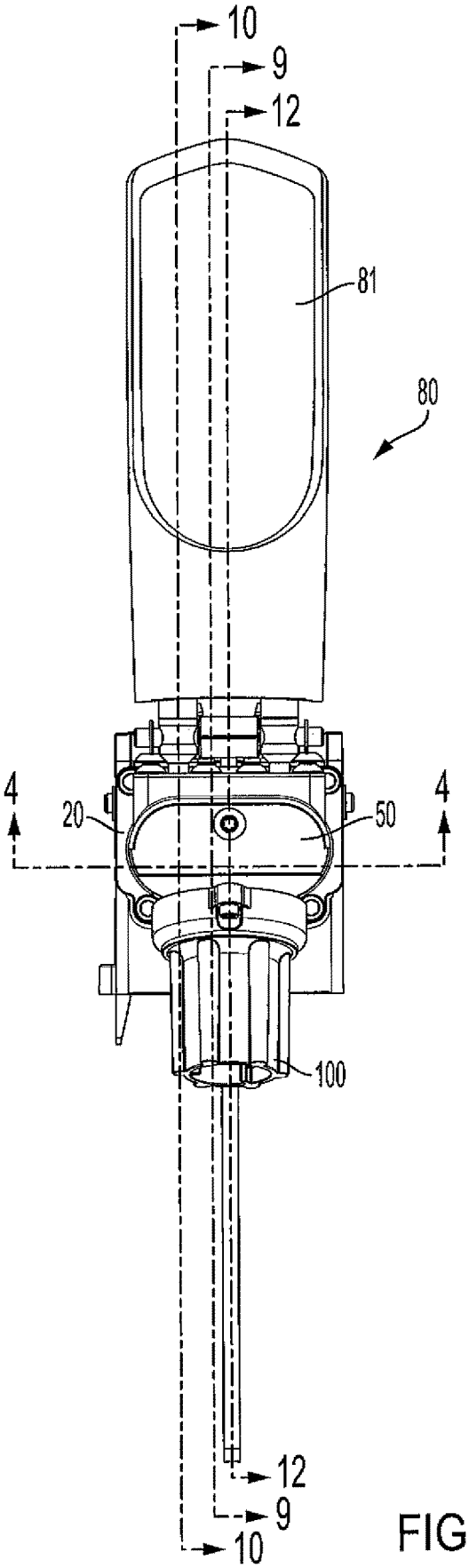
FIG. 2 is a front view of the beverage dispensing valve of FIG. 1.

FIGS. 1-2 depict an example beverage dispenser 2 for dispensing a first liquid (e.g. carbonated water) and a second liquid (e.g. flavor syrup) in a mixed beverage (e.g. post-mixed soda beverage). Note that the liquids may be liquid solutions with gas infused therein. The beverage dispenser 2 includes a backblock mounting assembly 6 (FIG. 1) to which a beverage dispensing valve 10 according to the present disclosure is removably coupled (components of which are described further hereinbelow). The backblock mounting assembly 6 is connected to conventional liquid sources (not shown; e.g., bag-in-box container, pressurized carbonated water tank) via liquid supply lines (not shown) such that the first liquid and the second liquid are received into the backblock mounting assembly 6. The backblock mounting assembly 6 includes valves 7 (FIG. 3) that close when the beverage dispensing valve 10 is disconnected by the backblock mounting assembly 6 and open when the beverage dispensing valve 10 is connected to the backblock mounting assembly 6. When the beverage dispensing valve 10 is connected, the valves 7 of the backblock mounting assembly 6 open and permit the first and second liquids to be conveyed into and through the beverage dispensing valve 10. Reference is made to the above-incorporated U.S. patents for example of conventional backblock mounting assemblies.

Figure 3:
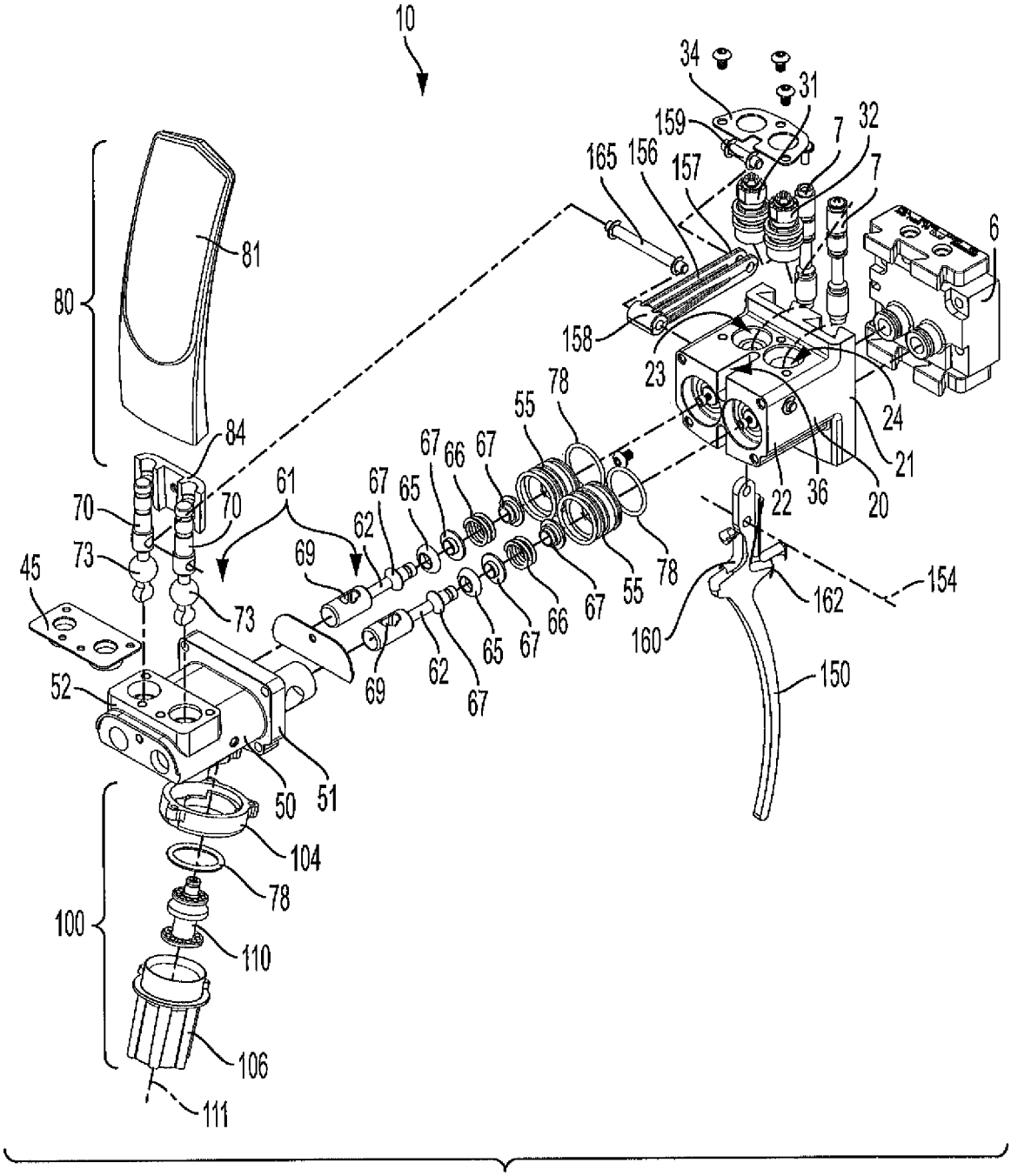
FIG. 3 is an exploded view of the beverage dispensing valve of FIG. 1.

Referring now to FIG. 3, an exploded view of the beverage dispensing valve 10 is depicted. Note that various fasteners for connecting the components of the beverage dispensing valve 10 are shown in FIG. 3. The beverage dispensing valve 10 has a flow control body 20 with a first end 21 coupled to the backblock mounting assembly 6 and an opposite, second end 22 to which a manifold 50 (described hereinbelow) is coupled. The flow control body 20 has a first chamber 23 that receives the first liquid from the backblock mounting assembly 6 and dispenses the first liquid to the manifold 50. Similarly, a second chamber 24 receives the second liquid from the backblock mounting assembly 6 and dispenses the second liquid to the manifold 50. A flow control 31, 32 is disposed in each chamber 23, 24 (e.g. a first flow control 31 is in the first chamber 23 and a second flow control 32 is in the second chamber 24), and the flow controls 31, 32 control (e.g. limit) the flow or flow rate of the first and second liquids, respectfully, through the beverage dispensing valve 10. That is, the first flow control 31 controls the flow rate of the first liquid through the beverage dispensing valve 10 and the second flow control 32 controls the flow rate of the second liquid through the beverage dispensing valve 10. As such, the first and second liquids flow at a predetermined, desired flow ratio through the beverage dispensing valve 10. For example, the first flow control 31 controls the flow rate of the first liquid (e.g. carbonated water) such that four parts of the first liquid is dispensed from the beverage dispensing valve 10 and the second flow control 32 controls the flow rate of the second liquid (e.g. flavor syrup) such that one part of the second liquid is dispensed from the beverage dispensing valve 10. In this example, the flow ratio of the first and second liquids through the beverage dispensing valve 10 is 4:1. The flow controls 31, 32 can be adjusted by a technician to vary the flow ratio of the liquids dispensed from the beverage dispensing valve 10. Reference is made to the above-incorporated U.S. Pat. No. 5,845,815 for examples of conventional flow controls. A retainer 34 couples the flow controls 31, 32 to the flow control body 20 and prevents the flow controls 31, 32 from being inadvertently removed from the flow control body 20.

Figure 4:
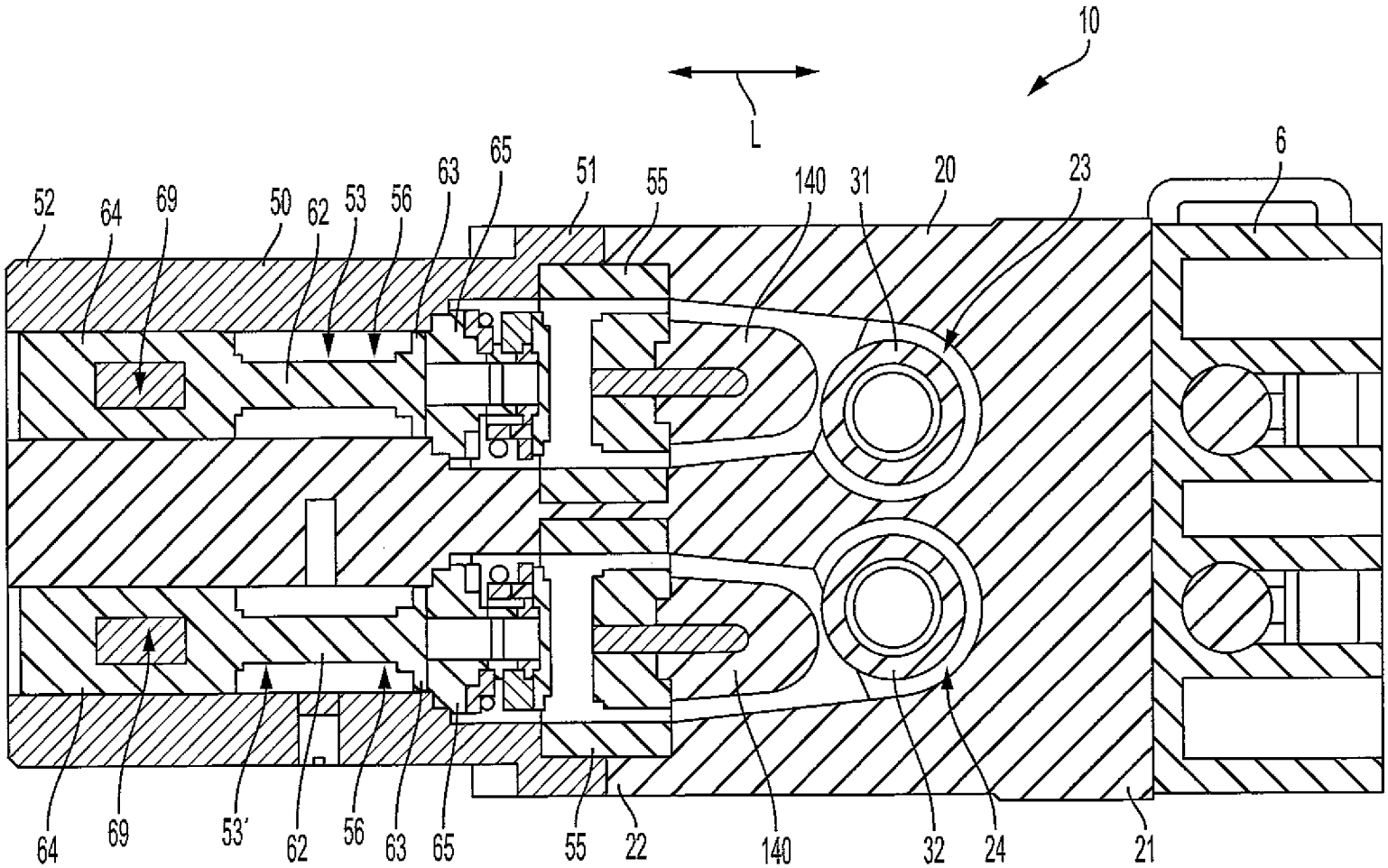
FIG. 4 is a cross-sectional view of the beverage dispensing valve of FIG. 1 along line 4-4 on FIG. 2.
Figure 5:
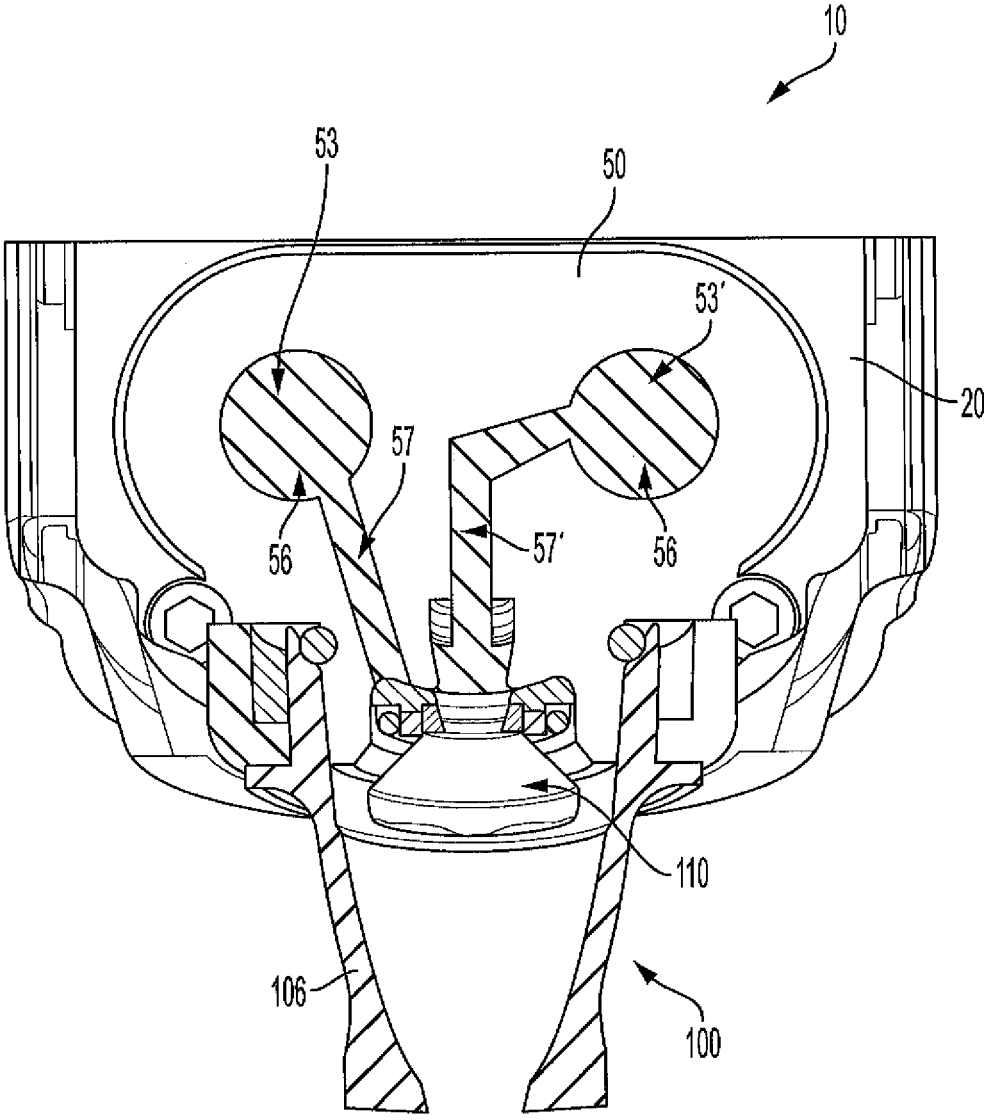
FIG. 5 is a cross-sectional view of the dispensing valve of FIG. 1 along line 5-5 on FIG. 1. Shutoff assemblies of the beverage dispensing valve are removed for clarity.
Figure 9:
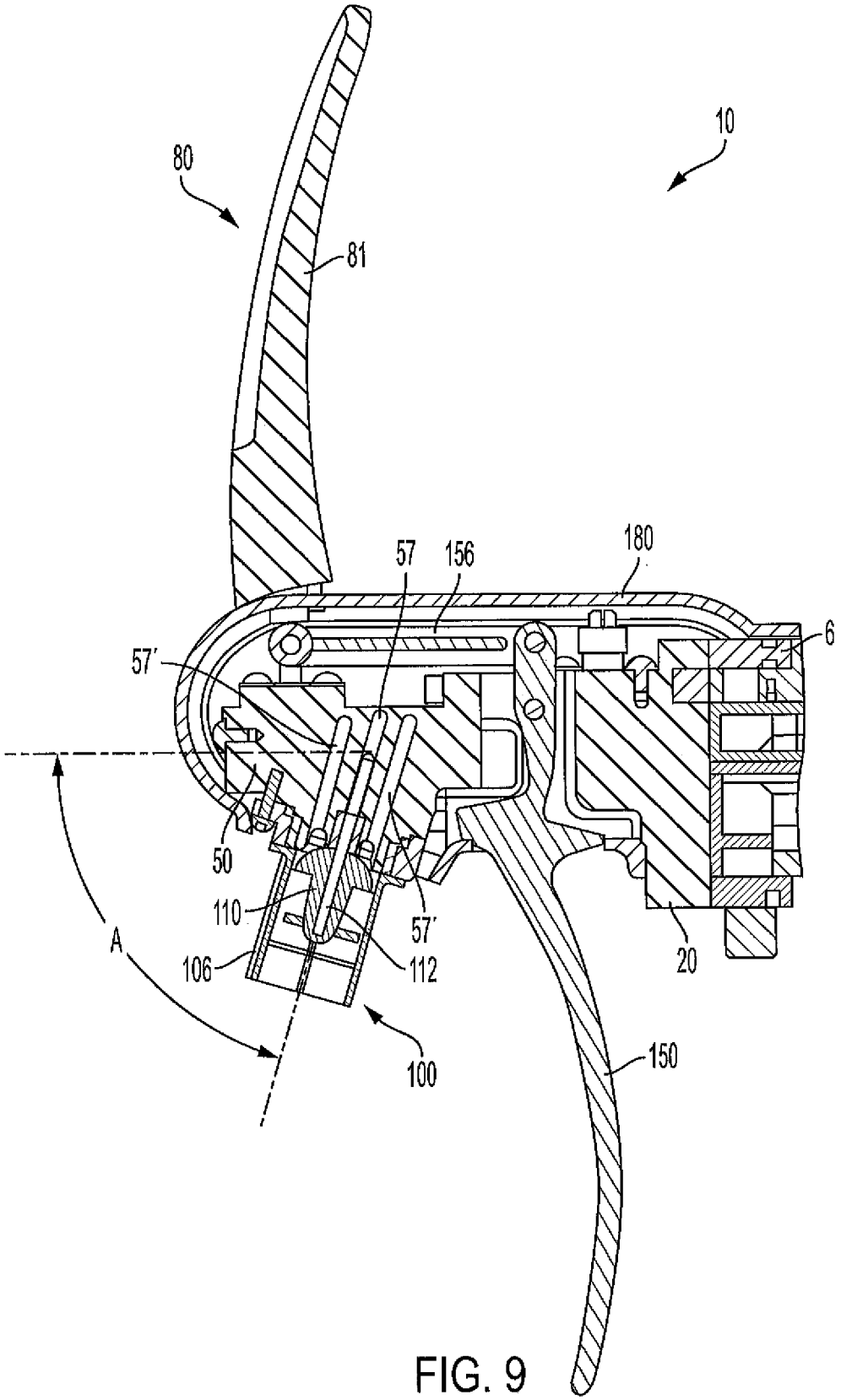
FIG. 9 is a cross-sectional view of the dispensing valve of FIG. 1 along line 9-9 on FIG. 2.

The manifold 50 has a first end 51 coupled to the second end 22 of the flow control body 20 with a manifold connector ring 55 and an opposite, second end 52 with a manual pull handle assembly 80 and a nozzle 100 connected thereto (both described hereinbelow). The first and second liquids dispensed from the chambers 23, 24 of the flow control body 20 are each received into separate flow channels 53, 53' (see FIGS. 4-5) which extend through the manifold 50 and terminate at the nozzle 100. During operation, the first liquid is conveyed through flow channel 53 and the second liquid is conveyed through the flow channel 53' (FIG. 4), and the first and second liquids dispense into the nozzle 100 where the first and second liquids mix to form the mixed beverage. As can be best seen in FIG. 4, each flow channel 53, 53' has a first section 56 that extends from the first end 51 of the manifold 50 toward the second end 52. The first sections 56 of the flow channels 53, 53' are parallel to each other and extend in a longitudinal direction (see arrow L on FIG. 4). Each flow channel 53, 53' also has a second section 57, 57', which is best seen in FIGS. 5 and 9 (e.g. flow channel 53 has a second section 57' and flow channels 53' has a second section 57'). The second sections 57, 57' of the flow channels 53, 53' extend transverse to the first sections 56 of the flow channels 53, 53' and are configured to direct the first and second liquids, respectively, to different sections of the nozzle 100. In certain examples, a second section 57, 57' of the flow channel 53, 53' may be divided into multiple sections that extend transverse from the first section 56 (see FIG. 9).

A shutoff assembly 61 is at least partially received into each flow channels 53, 53' (see FIG. 4) and is moveable within the flow channel 53, 53' to thereby selectively permit flow of the first and second liquid through the beverage dispensing valve 10. In particular, the shutoff assembly 61 has a leg 62 movably positioned within one of the flow channel 53, 53' (FIG. 4) and an arm 70 is pivotably coupled to the leg 62 and extends through and away from the manifold 50 (see also FIG. 10). The arm 70 extends transverse to the flow channel 53, 53' and pivots relative to the leg 62 (described further herein). A retainer 45 couples the arms 70 to the manifold 50 and prevents the arms 70 from being inadvertently removed.

Figure 6:
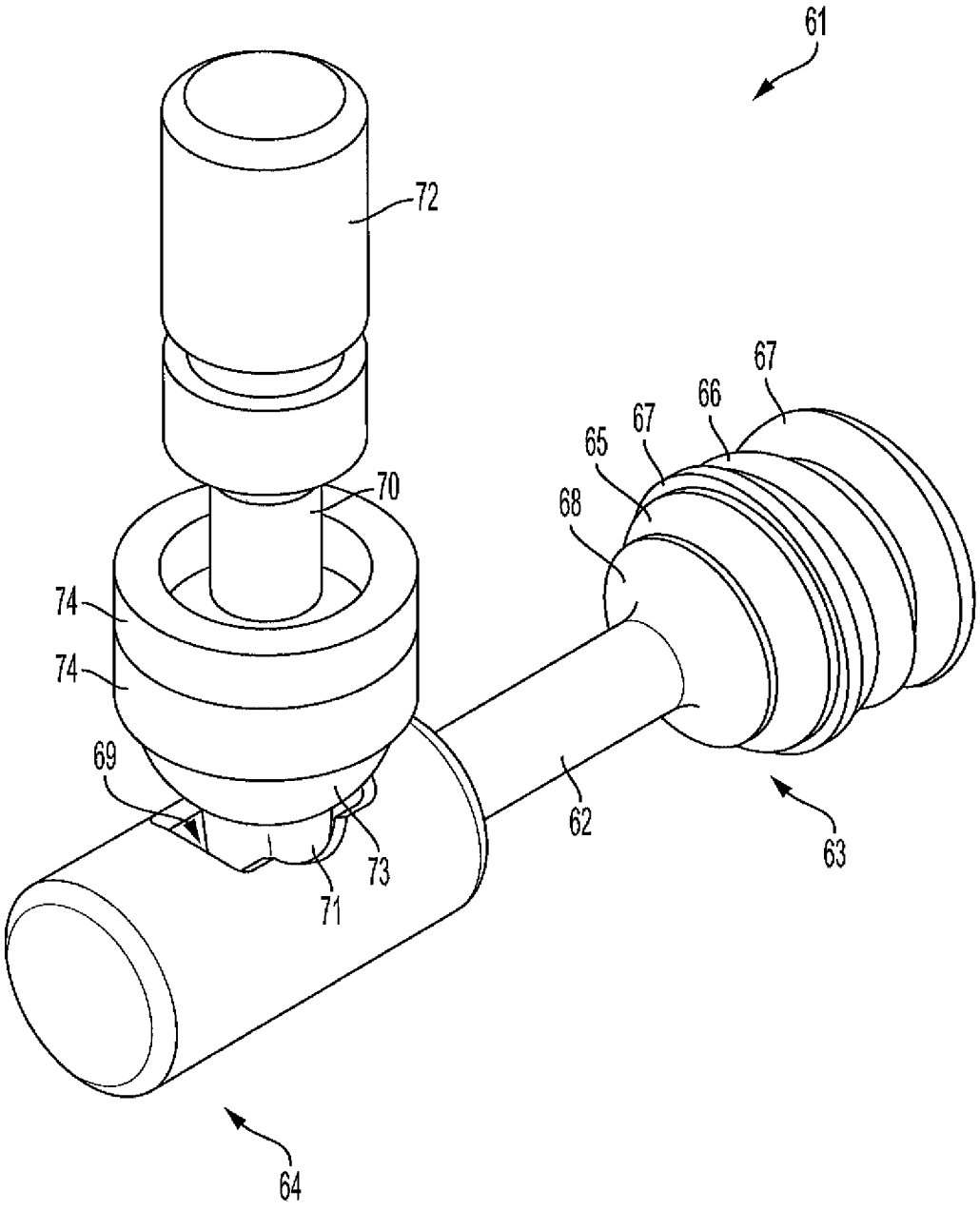
FIG. 6 is a perspective view of an example shutoff assembly according to the present disclosure.
Figure 7:
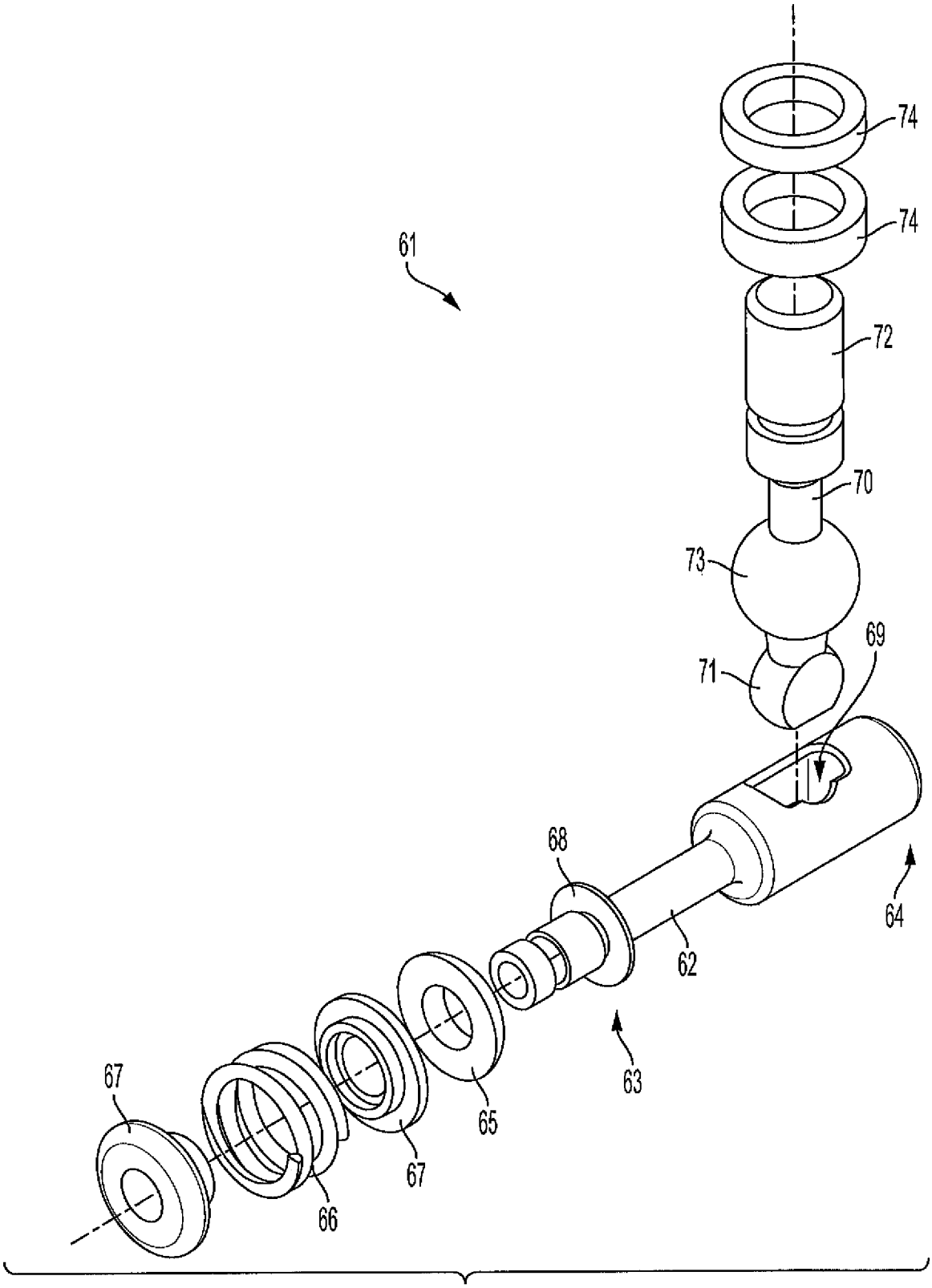
FIG. 7 is an exploded view of the shutoff assembly of FIG. 6.

Specifically referring to FIGS. 6-7, an example shutoff assembly 61 is shown in greater detail. The leg 62 has a first end 63 and an opposite, second end 64. The diameter of the leg 62 can vary along the length of the leg. A valve seal 65, a spring 66, and a pair of separator components 67 at opposite ends of the spring 66 are attached to the first end 63 of the leg 62. The valve seal 65 is seated against (e.g. contacts) a flange 68 of the leg 62. The leg 62 has a hole 69 at the second end 64. The arm 70 has a first end 71 pivotally received into the hole 69 of the leg 62 and an opposite second end 72 that is coupled to the handle assembly 80 (see FIG. 3). The arm 70 includes a ball 73 positioned between the ends 71, 72 that is pivotably coupled to the manifold 50 (see FIG. 10). Gaskets 74 are coupled to the arm 70 to create a liquid-tight seal between the manifold 50 and the arm 70. Note that additional gaskets 78 can be provided between various components of the beverage dispensing valve 10, as seen in FIG. 3.

Referring back to FIG. 3, a handle assembly 80 is coupled to the second end 52 of the manifold 50 and/or the second ends 72 of the arms 70 such that the handle assembly 80 can be selectively engaged and pivoted by the operator to thereby dispense the mixed beverage. That is, when the operator pivots of the handle assembly 80 the arms 70 pivot relative to the legs 62 such that the legs 62 move or translate in the flow channels 53, 53' (FIG. 4) and the valve seals 65 open and close (described further herein) permitting the first and second liquid to flow through the beverage dispensing valve 10 and mix to form the mixed beverage. The handle assembly 80 includes a handle retainer 84 and a handle member 81 that clamp onto the arms 70. The handle member 81 includes indicia (e.g. color, text, logo) that indicates to the operator and/or a consumer the mixed beverage that dispenses from the beverage dispensing valve 10 through the nozzle 100. In certain examples, the handle retainer 84 has a threaded rod (not shown) to which the handle member 81 is removably attached. In this example, the handle member 81 can be easily changed by the operator when the mixed beverage dispensed from the beverage dispensing valve 10 changes.

A dispensing arm 150 is also included with the beverage dispensing valve 10 to provide an alternative way of dispensing the mixed beverage. The dispensing arm 150 has a first end 151 and an opposite, second end 152. The dispensing arm 150 includes a curved seat edge 160 (described hereinbelow) between the first and second end 151, 152. The second end 152 is received into a slot 36 defined in the flow control body 20 and pivotally attached (e.g. pined) to the flow control body 20 at a pivot axis 154 between the first end 151 and the second end 152 of the dispensing arm 150 (see also FIGS. 12-13). A linkage 156 has a first end 157 coupled to the second end 152 of the dispensing arm 150 with a first pin 159 and an opposite, second end 158 that is coupled to the handle assembly 80 and/or the arms 70 with a second pin 165 (see also FIGS. 12-13). As such, when a cup (not shown) pushes on the first end 151 of the dispensing arm 150 the second end 152 pivots about the pivot axis 154 such that the second end 152 acts on (e.g. pushes) the linkage 156 which acts on (e.g. pivots) the handle assembly 80 and/or the arms 70 to cause the valve seals 65 to open and the mixed beverage to be dispensed (as described above). In certain examples, the linkage 156 is pivotally coupled to the arms 70 of the shutoff assemblies 61 with the second pin 165 and the handle assembly 80 is fixedly coupled to the arms 70 of the shutoff assemblies 61.

Figure 8:
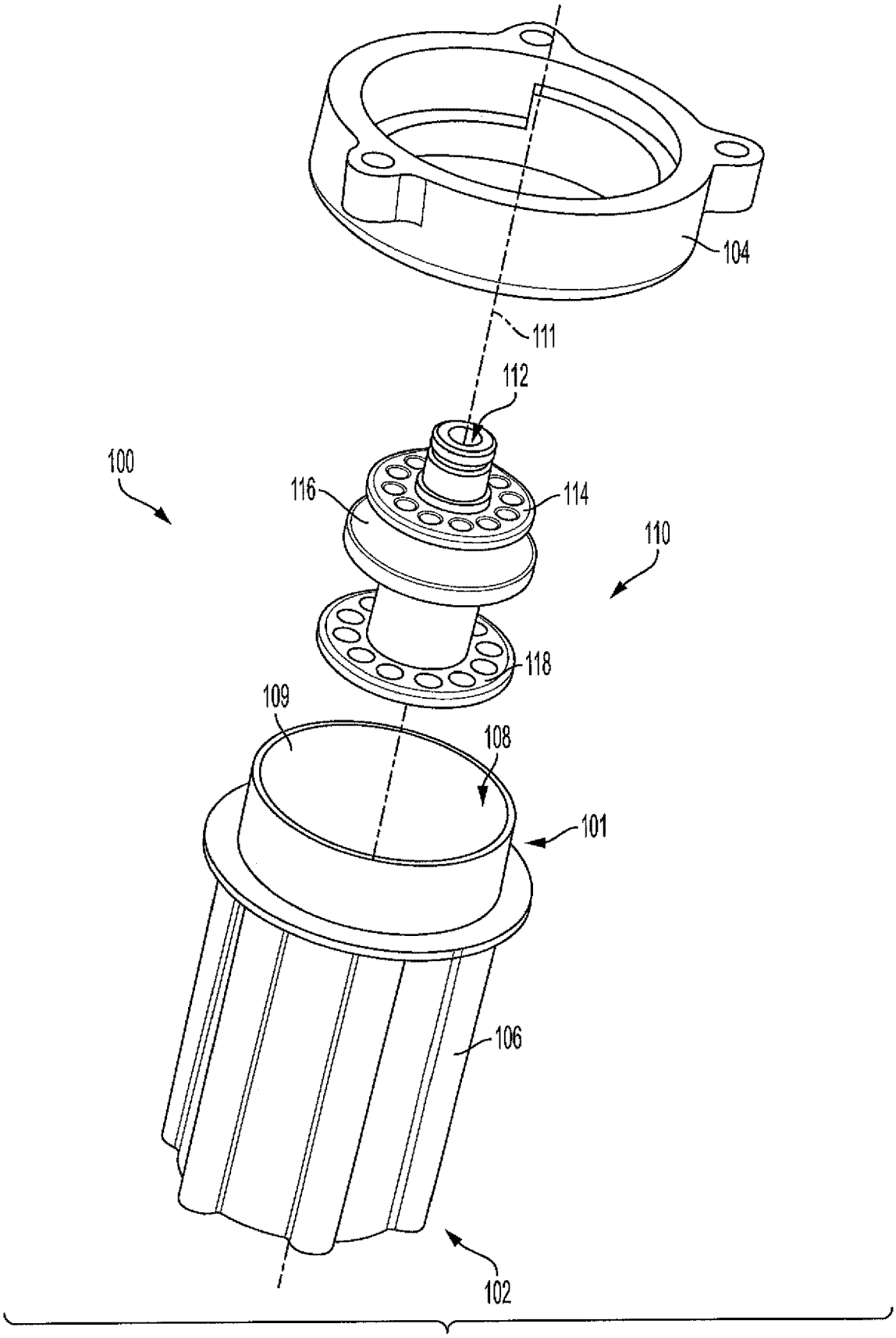
FIG. 8 is an exploded view of a nozzle according to the present disclosure.

Referring to FIG. 8, the nozzle 100 is shown in greater detail. The nozzle 100 receives the first and second liquids dispensed from the flow channels 53, 53' (FIG. 4), mixes the first and second liquids to form the mixed beverage, and dispenses the mixed beverage to the operator. The nozzle 100 has a body 106 with a first end 101 removably coupled to the second end 52 of the manifold 50 with a retainer 104 and an opposite, second end 102 from which the mixed beverage is dispensed to the operator. The body 106 has an inner perimeter surface 109 and defines a chamber 108 into which the first and second liquids are received from the flow channels 53, 53' (FIGS. 4-5). A diffuser 110 is positioned in the chamber 108 to mix the first and second liquids. The diffuser 110 extends along an axis 111 and has a bore 112 centered on the axis 111 through which the second liquid to conveyed from the flow channel 53' (FIG. 5). The bore 112 receives the second liquid from the flow channel 53'. The second liquid in the bore 112 is sprayed through holes 113 (see FIG. 12-13) toward the inner perimeter surface 109. The diffuser 110 also includes a first perforated ring 114, a radially outwardly sloping deflector surface 116, and a second perforated ring 118 that diffuse and radially outwardly direct the first liquid toward the inner perimeter surface 109. That is, the first liquid dispensed from the flow channel 53 (see FIG. 5) is conveyed by gravity through holes in the first perforated ring 114, radially outwardly directed toward the inner perimeter surface 109 by the deflector surface 116, and through holes in the second perforated ring 118 such that the first liquid is uniformly conveyed along the inner perimeter surface 109. As the first liquid is conveyed along the inner perimeter surface 109, the second liquid is sprayed toward the inner perimeter surface 109 to mix with the first liquid and form the mixed beverage. The nozzle 100 is angled (see angle A on FIG. 9) relative to the manifold 50 to thereby promote drainage of residual amount of the liquids and/or the mixed beverage that may remain in the nozzle 100 after each dispense.

Figure 10:
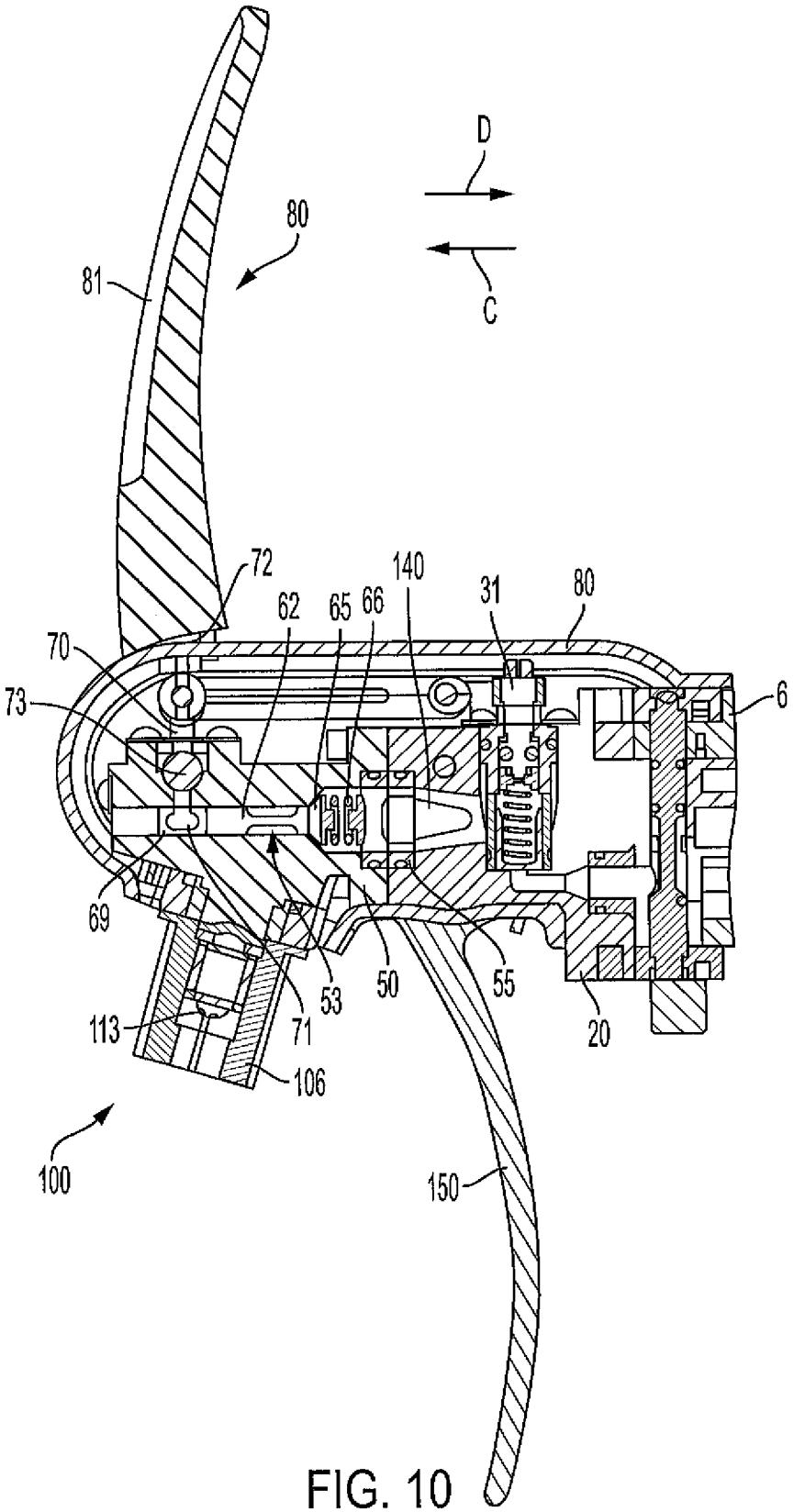
FIG. 10 is a cross-sectional view of the dispensing valve of FIG. 1 along line 10-10 on FIG. 2 with a handle assembly in a first position and a dispensing arm in a first position.
Figure 11:
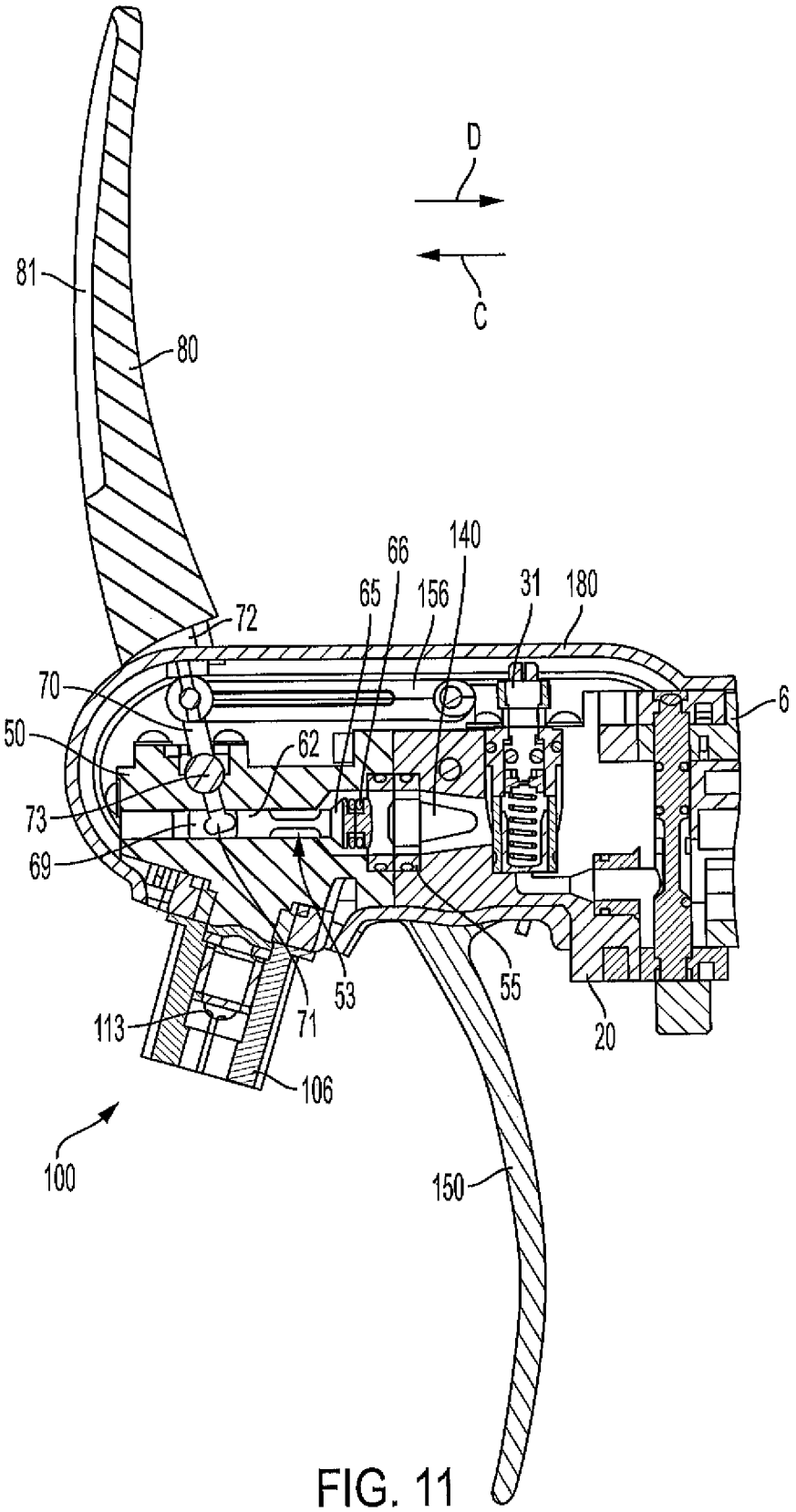
FIG. 11 is a cross-sectional view of the dispensing valve of FIG. 1 along line 10-10 on FIG. 2 with the handle assembly in a second position and the dispensing arm in a second position.

Referring now to FIGS. 10-11, an example operational sequence for operating the beverage dispensing valve 10 is depicted. Note that FIGS. 10-11 are cross-sectional views through one of the flow channels 53, and a person ordinary skill in the art will recognize that as the components of the beverage dispensing valve 10 are moved with reference to the depicted flow channel 53 the components associated with the other flow channel 53' can be simultaneously or sequentially operated and moved. The beverage dispensing valve 10 is shown with a removable cover 180.

Referring to FIG. 10, the handle assembly 80 is shown in a rest or first position. In the rest position, the leg 62 of the shutoff assembly 61 is in a closed or first position such that the outer edge of the valve seal 65 contacts the interior sidewall of the flow channel 53 thereby blocking or preventing the flow of the pressurized first liquid from upstream to downstream (e.g. the valve seal 65 is in a closed position such that first liquid does not flow through the beverage dispensing valve 10). The pressure of the first liquid upstream of the valve seal 65 applies a force in a first direction (see arrow C) to the valve seal 65 thereby maintaining the closed position of the valve seal 65. In other examples, the spring 66 applies a spring force in the first direction to the leg 62 to thereby bias the leg 62 into the closed position and the valve seal 65 into the closed position.

Referring to FIG. 11, the handle assembly 80 is shown in an open or second position. The handle assembly 80 is moved from the rest position (FIG. 10) to the open position (FIG. 11) when the operator applies a force to the handle assembly 80 in the first direction (see arrow C). As the operator applies the force to the handle assembly 80 in the first direction, the arm 70 pivots about the ball 73 such that the first end 71 of the arm 70 acts on the leg 62 and thereby moves or translates the leg 62 in the flow channel 53 in a second direction (see arrow D). As the leg 62 moves in the second direction (see arrow D) the valve seal 65 also moves in the second direction to an open position (e.g. opens) such that the outer edge of valve seal 65 becomes spaced apart from the interior sidewall of the flow channel thereby permitting the first liquid to flow past the valve seal 65 and through the beverage dispensing valve 10. Note that in order for the leg 62 to move and the valve seal 65 to open, the force applied by the operator to the handle assembly 80 and transferred to the leg 62 via the arm 70 must be greater than the force of the pressure of the first liquid acting in the first direction (see arrow C). That is, the force applied by the leg 62 in the second direction must be greater than the force of the pressure of the first liquid acting in the first direction against the leg 62. If the force applied via the leg 62 is not greater than the force of the first liquid acting in the first direction, the leg 62 will not move and the valve seal 65 will not open. Furthermore, when the spring 66 is included the force applied via the leg 62 in the second direction must be greater than the spring force applied by the spring 66 in the first direction to the leg 62.

To move the leg 62 to the closed position and the valve seal 65 to the closed position (e.g. close the valve seal 65) the handle assembly 80 is moved by the operator in the second direction (see arrow D) such that the leg 62 moves to the closed position and the valve seal 65 closes (see FIG. 10). In another example, after the operator stops applying a force to the handle assembly 80 in the first direction (see arrow C) the spring force of the spring 66 and/or the force of the pressure of the first liquid in the first direction automatically causes the leg 62 to move to the closed position, the valve seal 65 closes, and the handle assembly 80 to pivot to the rest position (FIG. 11). In certain examples, the movement of the handle assembly 80, the legs 62, the valve seals 65 and other components of the beverage dispensing valve 10 may be reversed to dispense the mixed beverage (e.g. the handle assembly 80 moves in the second direction from the rest position and the leg 62 is moved in the first direction, etc.). In certain examples, when the handle assembly 80 is moved in the second direction (arrow D) from the rest position (FIG. 10) the leg 62 moves slightly such that the liquids flow through a narrow channel at the center of the leg 62 thereby creating a rapid flow of lower pressure liquid that releases gasses in the liquid to create a foaming effect for embellishing the mixed beverage.

As noted above, the handle assembly 80 is coupled to both arms 70 of the shutoff assemblies 61, and as such, pivoting the handle assembly 80 simultaneously moves the legs 62 and valves seals 65 into and between the open and closed positions (e.g. the valve seals 65 simultaneously open and close). In other examples, the components of the shutoff assemblies 61 in each of the flow channels 53, 53 may vary relative to each other (e.g. the length of the legs 62 are different, the location and/or the size of the valve seals 65 relative to the leg 62 is different) such that pivoting the handle assembly sequentially moves the valve seals 65 into and between the open and closed positions (e.g. the valve seals 65 sequentially open and close).

Figure 12:
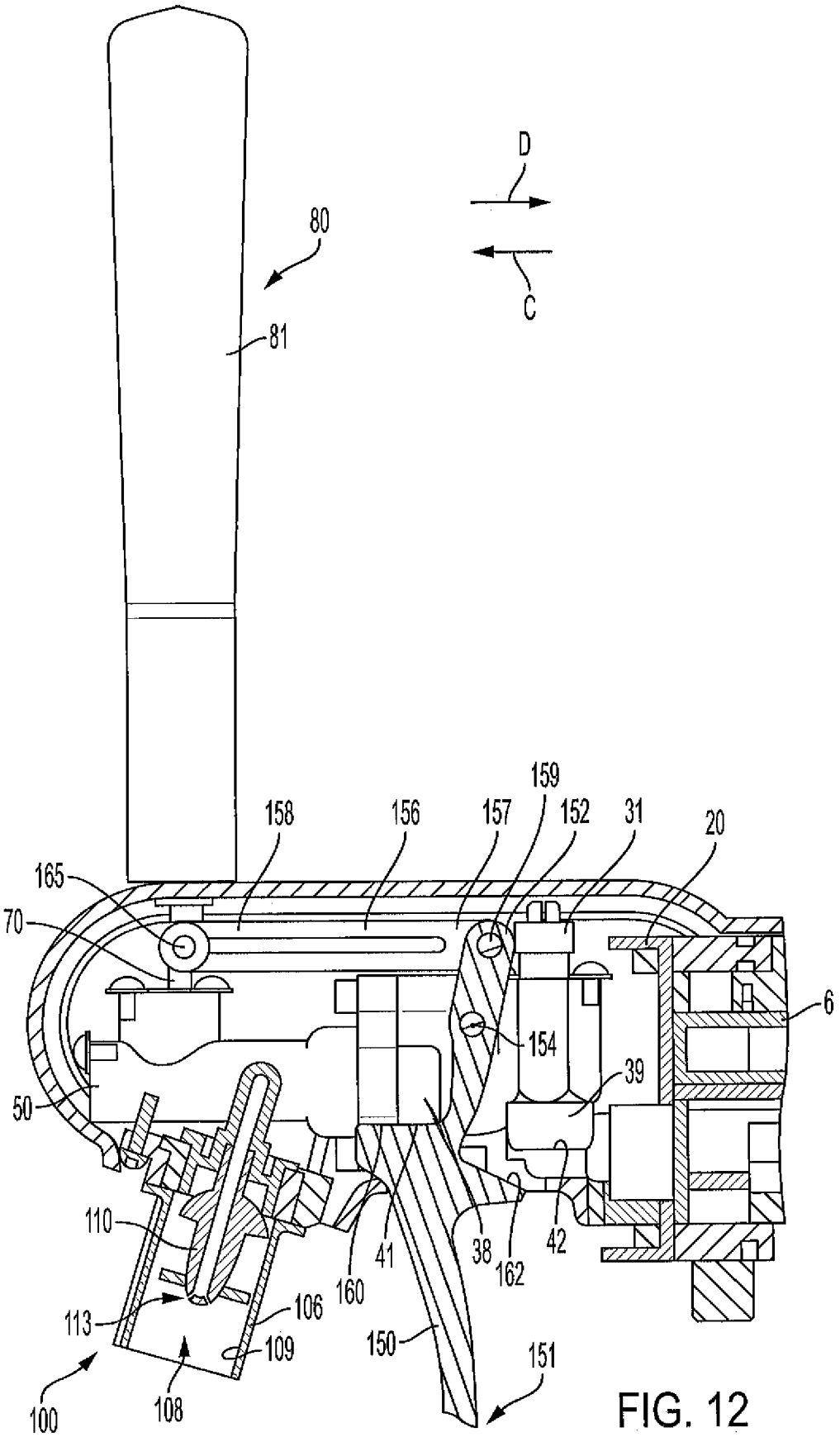
FIG. 12 is a cross-sectional view of the dispensing valve of FIG. 1 along line 12-12 on FIG. 2 with the handle assembly in the first position and the dispensing arm in the first position.
Figure 13:
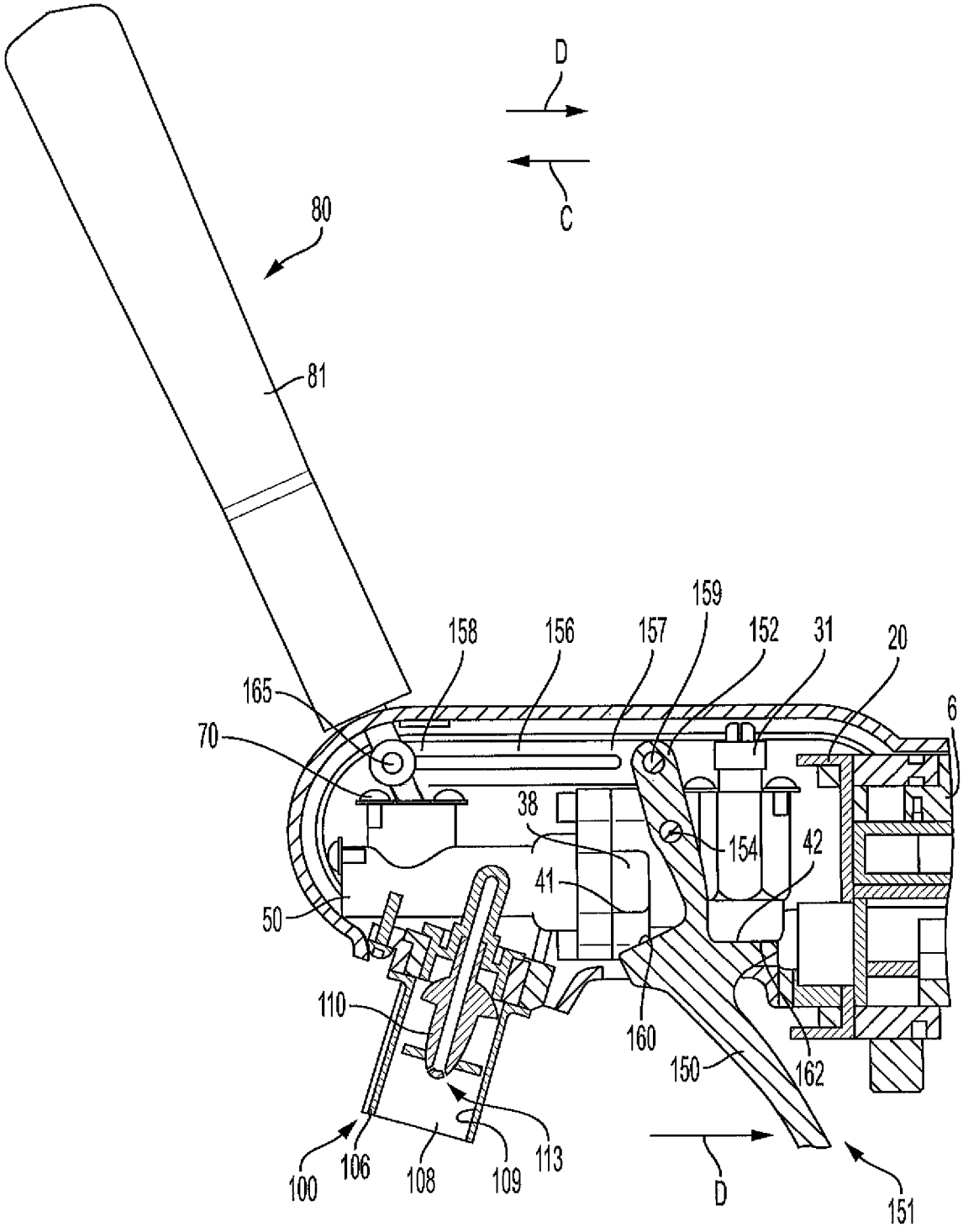
FIG. 13 is a cross-sectional view of the dispensing valve of FIG. 1 along line 12-12 on FIG. 2 with the handle assembly in the second position and the dispensing arm in the second position.

Referring now to FIGS. 12-13, the operation of the beverage dispensing valve 10 when a cup (not shown) is forced against the dispensing arm 150 is depicted and described below. FIG. 12 depicts the dispensing arm 150 in the rest position. In the rest position, the seat edge 160 of the dispensing arm 150 contacts a first boss 38 of the flow control body 20 that extends into the slot 36 (see also FIG. 3). Contact between the first boss 38 and the seat edge 160 prevents the dispensing arm from moving in the first direction (arrow C).

When a force is applied to the first end 151 of the dispensing arm 150 in the second direction (see arrow D at the dispensing arm 150 on FIG. 13) (e.g. the cup is forced into contact with the first end 151 of the dispensing arm 150) the dispensing arm 150 pivots about the pivot axis 154 and moves (e.g. pivots) to an open position (see FIG. 13). As the dispensing arm 150 pivots to the open position the first end 151 generally moves in the second direction (see arrow D) and the second end 152 of the dispensing arm 150 applies a force to the linkage 156 in the first direction (arrow C). The linkage 156 applies the force to the handle assembly 80 and/or the arms 70 such that the handle assembly 80 and/or the arms 70 pivot and the mixed beverage dispenses from the beverage dispensing valve 10, as described above. The dispensing arm 150 has a stop edge 162 that contacts a second boss 39 of the flow control body 20 to prevent the first end 151 of the dispensing arm 150 from moving in the first direction (arrow C). In certain examples, the shape of the first boss 38 (or the edge thereof) corresponds or matches the shape of the seat edge 160 and the shape of the second boss 39 corresponds or matches the shape of the stop edge 162. That is, the seat edge 160 and a first boss edge 41 of the first boss 38 nest with each other when the dispensing arm 150 is in the rest position (FIG. 12) and the stop edge 162 and a second boss edge 42 nest with each other when the dispensing arm 150 is in the open position (FIG. 13).

In certain example, a pressure reducing valve 140 (see FIG. 4) is disposed downstream from the flow control 31, 32 and is for gradually reducing the upstream dynamic liquid pressure towards atmospheric pressure when the valve seals 65 are in the open position and the first and second liquids flow through the beverage dispensing valve 10. The pressure reducing valve can be an annular diffuser. By gradually reducing the upstream dynamic liquid pressure towards atmospheric pressure, pressure "depressions" are prevented from forming in the beverage dispensing valve 10 which may cause gases in the liquids to come out of solution or "break out" of the liquids. As such, the gas levels (i.e. the carbonation levels) of the beverages dispensed from the beverage dispensing valve 10 are maximized. In another example, the pressure reducing insert can be configured to purposely "break out" gases from the liquid with a gas dissolved therein such that the beverage can be dispensed with a desired gas level (i.e. carbonation level).

In the present description, certain terms have been used for brevity, clarity, and understanding. No unnecessary limitations are to be inferred therefrom beyond the requirement of the prior art because such terms are used for descriptive purposes only and are intended to be broadly construed. The different apparatuses, systems, and methods described herein may be used alone or in combination with other apparatuses, systems, and methods. Various equivalents, alternatives, and modifications are possible within the scope of the appended claims.

What is claimed is:

1. A beverage dispensing valve comprising:

a manifold configured to receive and dispense a first liquid and a second liquid, the manifold has a first flow channel through which the first liquid is conveyed and a second flow channel through which the second liquid is conveyed, the second flow channel being parallel to and separated from the first flow channel;

a first shutoff assembly has a valve seal on a leg disposed in the first flow channel, the leg is movable into and between a closed position in which the valve seal blocks the flow of the first liquid through the first flow channel and an open position in which the valve seal is in an open position such that the first liquid flows through the first flow channel;

a second shutoff assembly has a valve seal on a leg disposed in the second flow channel, the leg is movable into and between a closed position in which the valve seal blocks the flow of the second liquid through the second flow channel and an open position in which the valve seal is in an open position such that the second liquid flows through the second flow channel;

a handle assembly coupled to the first shutoff assembly and the second shutoff assembly such that movement of the handle assembly moves the leg of the first shutoff assembly and the leg of the second shutoff assembly into the open position such that the first liquid flows through the first flow channel, the second liquid flows through the second flow channel, and the first liquid and the second liquid mix downstream of the first flow channel and the second flow channel to form a mixed beverage;

a nozzle into which the first liquid is dispensed from the first flow channel and the second liquid is dispensed from the second flow channel, wherein the nozzle mixes the first liquid and the second liquid to form the mixed beverage, and wherein the first liquid remains separated from the second liquid until the first liquid and the second liquid are mixed in the nozzle;

wherein the nozzle has an inner perimeter surface, a chamber, and a diffuser positioned in the chamber;

wherein the diffuser directs the first liquid toward the inner perimeter surface such that the first liquid is conveyed by gravity along the inner perimeter surface;

wherein the diffuser is configured to spray the second liquid toward the inner perimeter surface such that the second liquid mixes with the first liquid to form the mixed beverage;

wherein the first shutoff assembly has an arm pivotally coupled to and extending transverse to the leg of the first shutoff assembly;

wherein the second shutoff assembly has an arm pivotally coupled to and extending transverse to the leg of the second shutoff assembly; and wherein the handle assembly couples to the arm of the first shutoff assembly and the arm of the second shutoff assembly.

2. The beverage dispensing valve according to claim 1, wherein the leg of the first shutoff assembly has a flange that contacts the valve seal as the leg is moved toward the open position; and wherein the leg of the second shutoff assembly has a flange that contacts the valve seal when the leg is moved toward the open position.

3. The beverage dispensing valve according to claim 1, further comprising:

a flow control body configured to receive the first liquid from a first liquid source and the second liquid from a second liquid source and dispense the first liquid to the first flow channel and the second liquid to the second flow channel, the flow control body has a first flow control that controls flow rate of the first liquid and a second flow control that controls flow rate of the second liquid; and at least one connector ring that couples the flow control body to the manifold.

4. The beverage dispensing valve according to claim 3, wherein the flow control body has a first pressure reducing insert that gradually reduces pressure of the first liquid as the valve seal of the first shutoff assembly is opened and a second pressure reducing insert that gradually reduces pressure of the second liquid as the valve seal of the second shutoff assembly is opened to thereby prevent gases in the first liquid or the second liquid from coming out of solution.

5. The beverage dispensing valve according to claim 1, wherein the diffuser extends along an axis and has a first perforated ring, a radially outwardly sloping deflector surface downstream from the first perforated ring, and a second perforated ring downstream of the radially outwardly sloping deflector surface that collectively diffuse and radially outwardly direct the first liquid toward the inner perimeter surface.

6. The beverage dispensing valve according to claim 1, wherein the diffuser has a center bore;

wherein the first flow channel has a first section and a second section that is transverse to the first section, the second section directs the first liquid into the chamber of the nozzle;

wherein the second flow channel has a first section and a second section that is transverse to the first section, the second section directs the second liquid to the center bore of the diffuser; and wherein the first section of the first flow channel is parallel to the first section of the second flow channel.

7. A beverage dispensing valve comprising:

a manifold configured to receive and dispense a first liquid and a second liquid, the manifold has a first flow channel through which the first liquid is conveyed and a second flow channel through which the second liquid is conveyed;

a first shutoff assembly has a valve seal on a leg disposed in the first flow channel, the leg is movable into and between a closed position in which the valve seal blocks the flow of the first liquid through the first flow channel and an open position in which the valve seal is in an open position such that the first liquid flows through the first flow channel;

a second shutoff assembly has a valve seal on a leg disposed in the second flow channel, the leg is movable into and between a closed position in which the valve seal blocks the flow of the second liquid through the second flow channel and an open position in which the valve seal is in an open position such that the second liquid flows through the second flow channel;

a handle assembly coupled to the first shutoff assembly and the second shutoff assembly;

a dispensing arm coupled to the first shutoff assembly and the second shutoff assembly;

wherein movement of one of the handle assembly and the dispensing arm moves the leg of the first shutoff assembly and the leg of the second shutoff assembly into the open position such that the first liquid and the second liquid flow through the first and second flow channels and the first and second liquids mix downstream to form a mixed beverage; and wherein movement of the handle assembly in a first direction moves the leg of the first shutoff assembly and the leg of the second shutoff assembly in a second direction opposite the first direction and pivots the dispensing arm from a rest position toward an open position.

8. The beverage dispensing valve according to claim 7, wherein the dispensing arm has a first end and an opposite second end, and wherein the first end generally moves in the second direction as the dispensing arm pivots toward the open position.

9. The beverage dispensing valve according to claim 7, wherein movement of the dispensing arm toward the open position moves the leg of the first shutoff assembly and the leg of the second shutoff assembly in the second direction and the moves the handle assembly in the first direction.

10. The beverage dispensing valve according to claim 8, further comprising a flow control body configured to receive the first liquid from a first liquid source and the second liquid from a second liquid source and dispense the first liquid to the first flow channel and the second liquid to the second flow channel, the flow control body has a first flow control that controls flow rate of the first liquid and a second flow control that controls flow rate of the second liquid; and wherein the dispensing arm has a pivot axis positioned between the first end of the dispensing arm and the second end of the dispensing arm such that the dispensing arm is pivotally coupled to the flow control body at the pivot axis, the second end of the dispensing arm is coupled to the handle assembly with a linkage such that movement of the handle assembly in the first direction pivots the dispensing arm toward the open position.

11. The beverage dispensing valve according to claim 10, wherein the flow control body has a first boss that contacts the dispensing arm between the first end of the dispensing arm and the second of the dispensing arm when the dispensing arm is in the rest position to thereby prevent movement of the first end of the dispensing arm in the first direction.

12. The beverage dispensing valve according to claim 11, wherein the dispensing arm has a seat edge, and wherein the first boss has a first boss edge that corresponds to the seat edge such that the first boss edge nests with the seat edge when the dispensing arm is in the rest position.

13. The beverage dispensing valve according to claim 10, wherein the flow control body has a second boss that contacts the dispensing arm between the first end of the dispensing arm and the second end of the dispensing arm when the dispensing arm is in the open position to thereby prevent movement of the first end of the dispensing arm in the second direction.

14. The beverage dispensing valve according to claim 13, wherein the dispensing arm has a stop edge, and wherein the second boss has a second boss edge that corresponds to the stop edge such that the second boss edge nests with the stop edge when the dispensing arm is in the open position.

15. The beverage dispensing valve according to claim 10, wherein the first shutoff assembly has an arm pivotally coupled to and extending transverse to the leg of the first shutoff assembly;

wherein the second shutoff assembly has an arm pivotally coupled to and extending transverse to the leg of the second shutoff assembly; and wherein the handle assembly and the linkage are coupled to the arm of the first shutoff assembly and the arm of the second shutoff assembly.

16. The beverage dispensing valve according to claim 15, wherein the linkage is pivotally coupled to the arm of the first shutoff assembly and the arm of the second shutoff assembly with a pin, and wherein the handle assembly is fixedly coupled to the arm of the first shutoff assembly and the arm of the second shutoff assembly.

17. A beverage dispensing valve comprising:

a manifold configured to receive and dispense a first liquid and a second liquid, the manifold has a first flow channel through which the first liquid is conveyed and a second flow channel through which the second liquid is conveyed;

a first shutoff assembly has a valve seal on a leg disposed in the first flow channel and an arm pivotally coupled to and extending transverse to the leg, wherein the leg is movable into and between a closed position in which the valve seal blocks the flow of the first liquid through the first flow channel and an open position in which the valve seal is open such that the first liquid dispenses from the first flow channel;

a second shutoff assembly has a valve seal on a leg disposed in the second flow channel and an arm pivotally coupled to and extending transverse to the leg, wherein the leg is movable into and between a closed position in which the valve seal blocks the flow of the second liquid through the second flow channel and an open position in which the valve seal is open such that the second liquid dispenses from the second flow channel; and a handle assembly coupled to both the arm of the first shutoff assembly and the arm of the second shutoff assembly whereby movement of the handle assembly in a first direction moves the leg of the first shutoff assembly into the open position and the leg of the second shutoff assembly into the open position such that the first liquid dispenses from the first flow channel, the second liquid dispenses from the second flow channel, and the first and second liquids mix to form a mixed beverage.

18. The beverage dispensing valve according to claim 17, wherein movement of the handle assembly in a second direction opposite the first direction causes:

the first liquid to dispense at a pressure that is lower than pressure of the first liquid that dispenses when the handle assembly is moved in the first direction; and the second liquid to dispense at a pressure that is lower than pressure of the second liquid that dispenses when the handle assembly is moved in the first direction.

19. The beverage dispensing valve according to claim 17, wherein movement of the handle assembly in the first direction sequentially moves the leg of the first shutoff assembly and the leg of the second shutoff assembly.

20. The beverage dispensing valve according to claim 17, further comprising a dispensing arm coupled to the arm of the first shutoff assembly and the arm of the second shutoff assembly such that movement of one of the handle assembly and the dispensing arm moves the leg of the first shutoff assembly, the leg of the second shutoff assembly, and the other of the handle assembly and the dispensing arm.

* * * * *